US008778142B2

(12) United States Patent
Petschauer

(10) Patent No.: US 8,778,142 B2
(45) Date of Patent: Jul. 15, 2014

(54) SUCTION ROLL FOR DEWATERING A FIBROUS WEB

(75) Inventor: Franz Petschauer, Lannach (AT)

(73) Assignee: Andritz AG (AT)

( * ) Notice: Subject to any disclaimer, the term of this patent is extended or adjusted under 35 U.S.C. 154(b) by 0 days.

(21) Appl. No.: 13/879,270

(22) PCT Filed: Oct. 13, 2011

(86) PCT No.: PCT/AT2011/000424

§ 371 (c)(1),
(2), (4) Date: Apr. 12, 2013

(87) PCT Pub. No.: WO2012/054943

PCT Pub. Date: May 3, 2012

(65) Prior Publication Data

US 2013/0213879 A1 Aug. 22, 2013

(30) Foreign Application Priority Data

Oct. 27, 2010 (AT) ..... A 1783/2010

(51) Int. Cl.
*D21F 1/48* (2006.01)

(52) U.S. Cl.
USPC ..... 162/363; 162/364; 162/365; 210/386

(58) Field of Classification Search
USPC ..... 162/363, 364, 365–370; 210/386
See application file for complete search history.

(56) References Cited

U.S. PATENT DOCUMENTS

| | | | | |
|---|---|---|---|---|
| 2,204,780 | A * | 6/1940 | Thaler | 162/369 |
| 2,714,342 | A * | 8/1955 | Beachler | 162/370 |
| 2,772,606 | A * | 12/1956 | Kelly | 162/276 |
| 3,018,825 | A * | 1/1962 | Han et al. | 162/319 |
| 5,034,100 | A * | 7/1991 | Sides | 162/306 |
| 6,402,896 | B1 * | 6/2002 | Nikulainen et al. | 162/368 |
| 6,592,721 | B1 * | 7/2003 | Anderson et al. | 162/274 |
| 6,616,810 | B1 * | 9/2003 | Brogyanyi et al. | 162/301 |
| 6,682,632 | B2 * | 1/2004 | Nikulainen et al. | 162/368 |
| 2003/0008757 | A1 * | 1/2003 | Nikulainen et al. | 492/31 |
| 2013/0095989 | A1 * | 4/2013 | Eichler et al. | 492/15 |

FOREIGN PATENT DOCUMENTS

| | | |
|---|---|---|
| DE | 4103040 | 8/1992 |
| DE | 29822227 | 2/1999 |
| DE | 10329808 | 4/2004 |

OTHER PUBLICATIONS

DE 4103040, Freiber Paper, machine translation, 1992.*

DE 10329808,Metso Paper, machine translation, 2004.*

International Search Report for PCT/AT2011/000424, English translation attached to original, Both completed by the European Patent Office on Mar. 15, 2012, All together 5 Pages.

* cited by examiner

*Primary Examiner* — Mark Halpern

(74) *Attorney, Agent, or Firm* — Brooks Kushman P.C.

(57) ABSTRACT

A suction roll for dewatering a fibrous web, having a rotatable and perforated suction roll jacket and a suction box in the interior of the suction roll. The suction box has a first suction channel that extends in the interior of the roll essentially along the axis of the suction roll. The suction box also has a second suction channel that extends in the interior of the roll along the inner surface of the suction roll jacket and is delimited by seals. The first suction channel is connected to the second suction channel via at least one connecting channel.

8 Claims, 3 Drawing Sheets

SUCTION ROLL FOR DEWATERING A FIBROUS WEB

CROSS-REFERENCE TO RELATED APPLICATION

This application is the U.S. national phase of PCT Appln. No. PCT/AT2011/000424 filed on Oct. 13, 2011, which claims priority to AT Patent Application No. A 1783/2010 filed on Oct. 27, 2010, the disclosures of which are incorporated in their entirety by reference herein.

The subject of this invention is a suction roll for dewatering a fibrous web, having a rotatable and perforated suction roll jacket and a suction box. The suction box is located in the interior of the suction roll and connected to a negative pressure source in such a way that said suction box applies a negative pressure to an inner surface, that is delimited by seals, of the suction roll jacket, thus enabling a defined surface region of the suction roll to be aspirated.

A traditional suction roll is shown in FIG. 1. In the case of this suction roll, there is the risk of the filtrate not being able to be completely suctioned off at higher speeds and of the roll thus having a tendency to "spatter". The reason for this is to be found in the non-optimized suction channel. A suction roll of such type is disclosed in DE 298 22 227 U1. DE 103 29 808 A1 describes a suction roll with a partitioned suction chamber, in which a regulating device for flows from the second part of the suction chamber into the first part may also be provided.

A further suction roll according to prior art is shown in FIG. 2. In this roll, the filtrate is extracted from the roll by means of a siphon; this does lead to an improvement in the extraction of filtrate, but in this case requires a further negative pressure connection for the siphon. A suction roll according to FIG. 2 is also disclosed in DE 41 03 040 A1.

The object of the invention is thus to optimize a suction roll in such a way that the filtrate can reliably be extracted from the suction roll.

This object is achieved by a suction roll with an optimized suction box. The suction box herein has a first and a second suction channel. The first suction channel extends in the interior of the suction roll substantitally along the axis of the suction roll, and the second suction channel extends in the interior of the roll along the inner surface of the suction roll jacket. The second suction channel is sealed off by seals which fit to the inside of the suction roll jacket. According to the invention, the first and the second suction channel are interconnected by at least one connecting channel. This connecting channel preferably extends in a radial direction (in relation to the geometry of the roll). It is further provided that the at least one connecting channel leads into the first suction channel above a collection region of the first suction channel, such that extracted water can accumulate in the collection region and does not run off back through the connecting channel.

This embodiment of the suction box according to the invention enables a significantly reduced aspirated internal volume of the suction roll to be achieved, as compared to traditional suction boxes. As a result of the reduced volume, high air speeds, which reliably carry along the extracted filtrate, occur in particular in the second suction channel.

It is advantageous that two press nips (pressure points A, B) of the suction roll are aspirated by the second suction channel, as the filtrate accruing at two locations is thus extracted by a single extraction.

In a favorable embodiment, retaining strips which extend in the running direction of the machine (C) are located in the interior of the second suction channel. This enables the dewatering performance of the suction roll to be improved yet further. The purpose of these retaining strips is to prevent a transverse flow in relation to the running direction in the interior of the suction zone of the second suction channel.

By means of the retaining strips, a non-aspirated region within the suction zone can be prevented. Furthermore this also achieves that the holes in the suction roll jacket cannot be covered by material, as they are being constantly rinsed with filtrate.

The retaining strips preferably have some mechanical play in relation to the suction roll jacket, that is to say that they do not form a seal against the suction roll jacket. The mechanical play of the suction strips in relation to the suction roll jacket may also be adjustable by means of an adjustment element.

In a favorable embodiment, the retaining strips extend from the second suction channel into the connecting channel which connects the second suction channel with the first suction channel. This further improves the guidance of the flow.

It is also conceivable that a further suction channel is located in the interior of the roll of the suction roll, through which a further defined surface region of the suction roll is aspirated. This suction zone can, for instance, be used for vacuum drying a cover. For the purpose of homogenizing the aspiration across the width of the machine, retaining strips may also be located in the further suction channel.

In the following, the invention is explained with reference to drawings, in which.

Identical reference signs in the respective figures refer to identical components.

Figure 1:
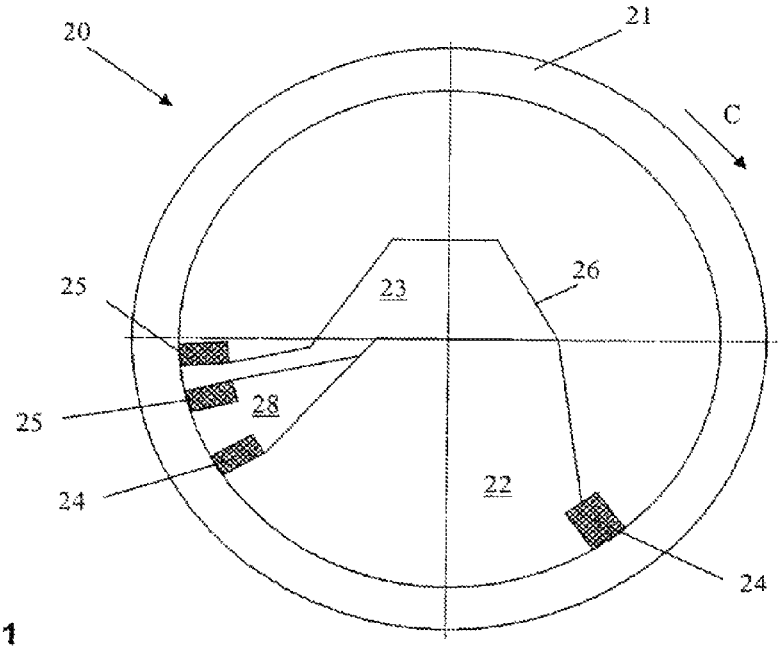
Fig. 1 Prior Art
FIG. 1 shows a schematic cross section of a suction roll according to prior art.

FIG. 1 shows a cross section of a traditional suction roll 20 with a perforated suction roll jacket 21 according to prior art with a non-optimized suction box 26. The suction box 26 comprises a first suction channel 22 and a second suction channel 23, each being sealed off against the suction roll jacket 21 by the seal strips 24 and 25, respectively. One or two press nips are aspirated through the first suction channel 22. A follow-on suction zone (cover drying zone) is aspirated through the second suction channel 23. A ventilation zone 28 is located between the two suction zones for the purpose of breaking the vacuum. The direction of rotation, or the running direction of the machine, respectively, is indicated by an arrow and the reference sign C.

In the case of this suction roll, there is the risk of the filtrate not being able to be completely suctioned off from the suction roll at higher speeds and of the roll 20 thus having a tendency to "spatter". This is dependent on the vacuum and on the circumferential speed.

Figure 2:
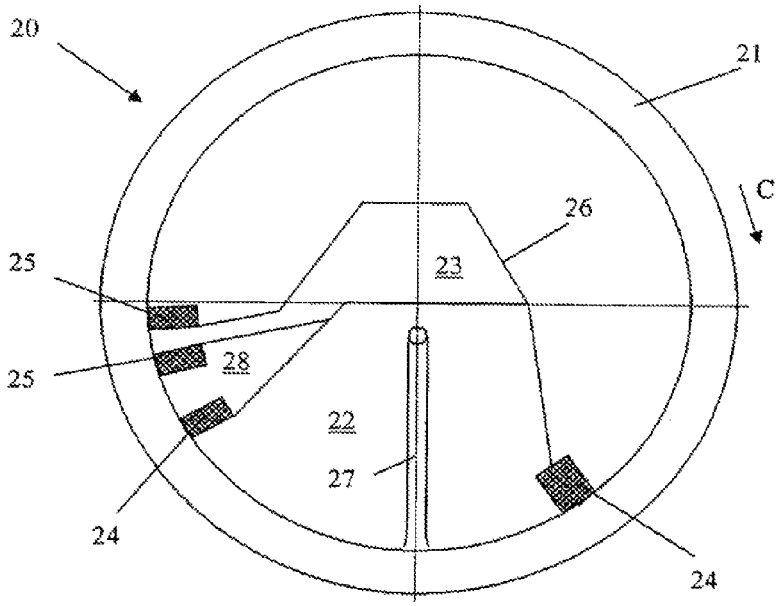
Fig. 2 Prior Art
FIG. 2 shows a further suction roll according to prior art.

FIG. 2 shows another suction roll 20 according to prior art; here, the filtrate is extracted within the suction roll 20 by means of a siphon 27 or multiple siphons 27.

Figure 3:
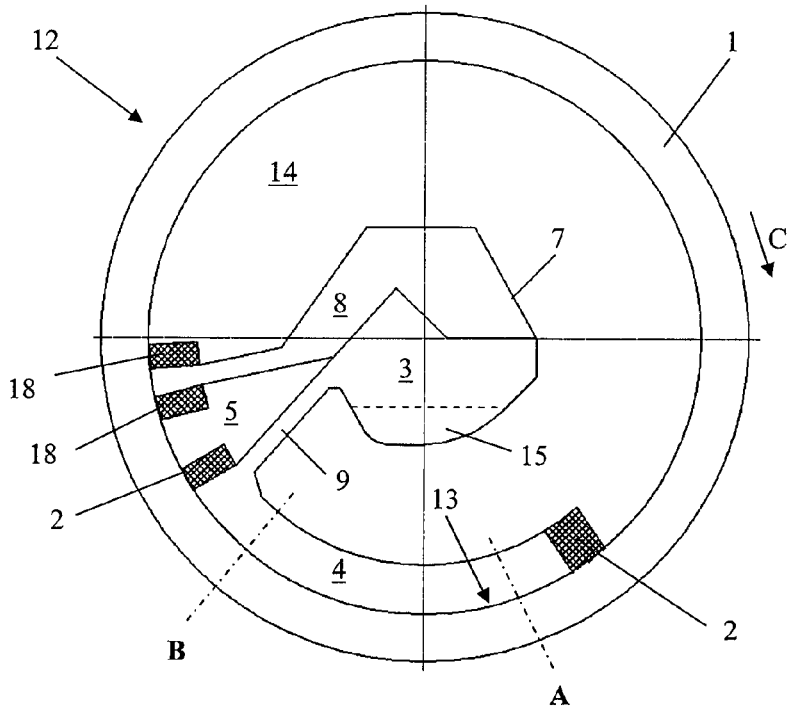
FIG. 3 shows a schematic cross section of the suction roll according to the invention.

FIG. 3 shows an exemplary embodiment of the suction roll 12 according to the invention. The suction roll 12 has a rotatable perforated roll jacket 1 and a suction box 7 located in the interior of the roll 14. The suction box 7 consists of a first suction channel 3 and a second suction channel 4, both suction channels 3, 4 being interconnected by one or more connecting channels 9. The first suction channel 3 extends substantially in the region of the suction roll axis and is connected to a negative pressure source. The second suction channel 4 extends along the inside surface 13 of the suction roll jacket 1 and in the present example is sickle-shaped. The second suction channel 4 is sealed off with respect to the atmosphere by the seal strips 2 which fit immediately against the suction roll jacket 1. The connecting channel 9 leads into the first suction channel 3 above a collection region 15 of the first suction channel 3. This enables extracted water (filtrate) to accumulate in the collection region 15 and to be discharged, and it thus does not run off back through the connecting channel 9 into the second suction channel 4. The suction box 7 illustrated in this exemplary embodiment further comprises a further suction channel 8, through which a further defined surface region of the suction roll jacket 1 may be aspirated. This region is sealed off by the seals 18 and serves for vacuum drying a cover. A ventilation zone 5 is located between the two suction zones for the purpose of breaking the vacuum.

In this example, two press nips A and B are aspirated through the second suction channel 4; the corresponding counter-rolls are not shown.

Figure 4:
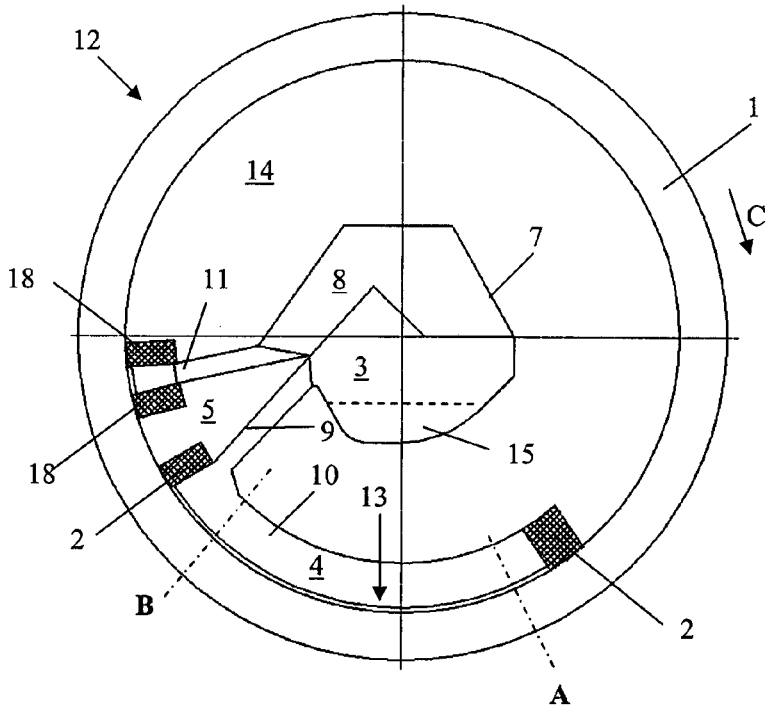
FIG. 4 shows the suction roll according to FIG. 3 with respective retaining strips.

FIG. 4 shows the suction roll 12 according to FIG. 3 with respective retaining strips 10, 11. The retaining strips 10, 11 extend parallel to the running direction of the machine C. By means of this arrangement, a non-aspirated region in the suction roll jacket 1 within the suction zone is to be avoided. Furthermore this also achieves that the holes in the suction roll jacket 1 cannot be covered by material (fibrous material), as they are constantly being rinsed 10 with filtrate. The purpose of these retaining strips 10 and/or 11 is to prevent a transverse flow in relation to the running direction C in the interior of the second suction channel 4. The retaining strips 10 and/or 11 preferably have a mechanical play in relation to the suction roll jacket 1, that is to say that they do not form a seal against the suction roll jacket 1.

The invention, of course, also comprises exemplary embodiments in which retaining strips 10 are only located in the second suction channel 4.

In the present example, the retaining strips 10 extend into the connecting channel 9 to guide the filtrate from the suction zone directly to the upper part of the first suction channel 3, from where it is extracted transversely from the suction box 7.

Figure 5:
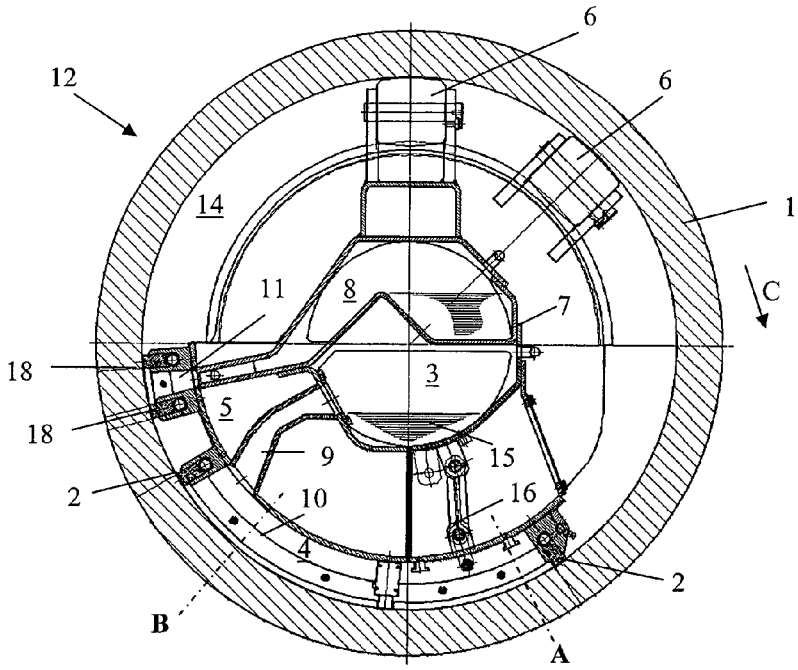
FIG. 5 shows a somewhat more detailed illustration of the suction roll according to FIG. 4.

FIG. 5 shows a somewhat more detailed illustration of the suction roll 12 according to FIG. 4. Here, the adjustment element 16 for the retaining strips 10 is shown, by means of which the mechanical play of the retaining strips 10 in relation to the suction roll jacket 1 can be set. The guide rolls 6 facilitate the removal of the suction box 7 for maintenance purposes.

Figure 6:
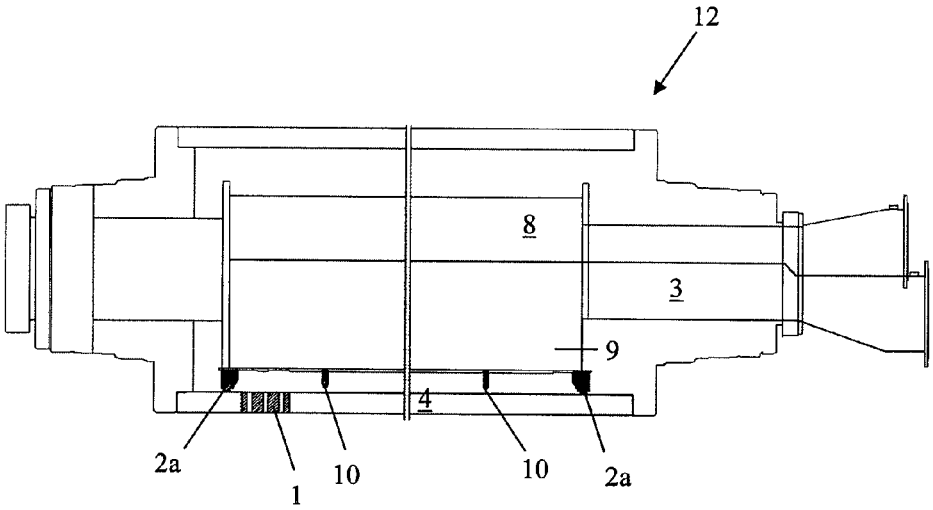
FIG. 6 shows a schematic longitudinal section of the suction roll according to the invention.

FIG. 6 shows a schematic longitudinal section of the suction roll 12 according to the invention. Apart from the retaining strips 10, the seal strips 2*a* are also visible, which seal off the suction zone of the second suction channel 4 in the running direction of the machine C with respect to the atmosphere.

The invention claimed is:

1. A suction roll for dewatering a fibrous web, comprising a rotatable and perforated suction roll jacket and a suction box, the suction box being connected to a negative pressure source in such a way that the former applies a negative pressure to an inner surface, that is delimited by seals, of the suction roll jacket, thus enabling a defined surface region of the suction roll to be aspirated, wherein the suction box has a first suction channel which extends in the interior of the roll substantially along the axis of the suction roll, and in that the suction box has a second suction channel which extends in the interior of the roll along the inner surface of the suction roll jacket and which is delimited by seals, the first suction channel being connected to the second suction channel by at least one connecting channel, and in that the at least one connecting channel leads into the first suction channel above a collection region of the first suction channel, such that extracted water can accumulate in the collection region and does not run off back through the connecting channel.

2. The suction roll as claimed in claim 1, wherein the at least one connecting channel extends substantially in the radial direction.

3. The suction roll as claimed in claim 1, wherein two press nips of the suction roll are aspirated by the second suction channel.

4. The suction roll as claimed in claim 1, wherein retaining strips which extend in the running direction of the machine are located in the interior of the second suction channel.

5. The suction roll as claimed in claim 4, wherein the retaining strips have a mechanical clearance in relation to the suction roll jacket.

6. The suction roll as claimed in claim 4, wherein the retaining strips extend from the second suction channel into the connecting channel.

7. The suction roll as claimed in claim 1, wherein a further suction channel, which enables a further defined surface region of the suction roll to be aspirated, is located in the interior of the roll.

8. The suction roll as claimed in claim 7, wherein retaining strips are located in the further suction channel.

* * * * *